US012345050B2

(12) United States Patent
Lee et al.

(10) Patent No.: US 12,345,050 B2
(45) Date of Patent: Jul. 1, 2025

(54) SYSTEM WALL FOR BUILDING INTERIOR

(71) Applicant: SAMWON ACT CO., LTD., Busan (KR)

(72) Inventors: Kyung Wook Lee, Ansan-si (KR); Kyung Yul Lee, Bucheon-si (KR); Hong Suk Han, Siheung-si (KR); Jae Sung Choi, Ansan-si (KR)

(73) Assignee: SAMWON ACT CO., LTD., Busan (KR)

( * ) Notice: Subject to any disclaimer, the term of this patent is extended or adjusted under 35 U.S.C. 154(b) by 547 days.

(21) Appl. No.: 17/623,178

(22) PCT Filed: Jun. 24, 2020

(86) PCT No.: PCT/KR2020/008238
§ 371 (c)(1),
(2) Date: Dec. 27, 2021

(87) PCT Pub. No.: WO2020/262966
PCT Pub. Date: Dec. 30, 2020

(65) Prior Publication Data

US 2022/0243478 A1 Aug. 4, 2022

(30) Foreign Application Priority Data

Jun. 26, 2019 (KR) ..... 10-2019-0076120

(51) Int. Cl.
*E04F 13/08* (2006.01)
*A47B 96/02* (2006.01)
*E04B 2/74* (2006.01)

(52) U.S. Cl.
CPC ..... *E04F 13/08* (2013.01); *A47B 96/028* (2013.01); *E04B 2/74* (2013.01); *E04B 2002/7483* (2013.01)

(58) Field of Classification Search
CPC ..... A47B 96/028; A47B 96/027; E04F 13/08; E04B 2/74; E04B 2002/7483
USPC ..... 52/27
See application file for complete search history.

(56) References Cited

U.S. PATENT DOCUMENTS

| | | | | |
|---|---|---|---|---|
| 693,127 | A * | 2/1902 | Gardner et al. | A47B 57/42 248/221.12 |
| 6,729,485 | B2 * | 5/2004 | Ehrgott | A47F 5/0823 248/221.11 |
| 7,828,263 | B2 * | 11/2010 | Bennett | E04G 13/00 249/219.1 |
| 9,618,027 | B1 * | 4/2017 | Gold | F16B 19/002 |
| 11,224,289 | B1 * | 1/2022 | Hutson | A47B 96/1408 |

(Continued)

FOREIGN PATENT DOCUMENTS

| | | |
|---|---|---|
| EP | 1 576 903 A1 | 9/2005 |
| JP | 2008-38585 A | 2/2008 |

(Continued)

*Primary Examiner* — Paola Agudelo
(74) *Attorney, Agent, or Firm* — Birch, Stewart, Kolasch & Birch, LLP

(57) ABSTRACT

The present invention is configured as follows. The present invention relates to a system wall characterized by comprising: a bracket attached to a wall part; a support attached to the bracket; a hole-processed metal panel corresponding to the support; and a decorative part inserted into the support protruding from the hole-processed metal panel.

15 Claims, 25 Drawing Sheets

(56) References Cited

U.S. PATENT DOCUMENTS

| | | | | |
|---|---|---|---|---|
| 11,432,648 | B1 * | 9/2022 | Black | A47B 96/066 |
| 2008/0185489 | A1 * | 8/2008 | Ehrgott | A47B 96/067<br>248/224.7 |
| 2009/0200254 | A1 * | 8/2009 | Hsu | A47B 96/028<br>248/231.91 |
| 2009/0266022 | A1 * | 10/2009 | Lin | E04F 15/10<br>52/506.1 |
| 2012/0117910 | A1 * | 5/2012 | Chuang | A47B 96/20<br>52/588.1 |
| 2012/0240363 | A1 * | 9/2012 | Lee | F16B 21/086<br>24/297 |
| 2014/0130719 | A1 * | 5/2014 | Raml | A47B 5/02<br>108/42 |
| 2019/0239646 | A1 * | 8/2019 | Newman | A47B 96/028 |
| 2020/0054134 | A1 * | 2/2020 | Severa | A47B 96/021 |
| 2020/0221871 | A1 * | 7/2020 | Sisto | A47B 96/028 |
| 2021/0045531 | A1 * | 2/2021 | Sisto | A47B 96/027 |
| 2022/0243478 | A1 * | 8/2022 | Lee | A47B 96/066 |
| 2023/0380594 | A1 * | 11/2023 | Anderson | A47B 96/028 |

FOREIGN PATENT DOCUMENTS

| | | | |
|---|---|---|---|
| KR | 20-0274992 | Y1 | 5/2002 |
| KR | 10-0431497 | B1 | 5/2004 |
| KR | 10-2019-0084215 | A | 7/2019 |

* cited by examiner

SYSTEM WALL FOR BUILDING INTERIOR

CROSS REFERENCE TO RELATED APPLICATIONS

This application is the National Phase of PCT International Application No. PCT/KR2020/008238, filed on Jun. 24, 2020, which claims priority under 35 U.S.C. 119(a) to Patent Application No. 10-2019-0076120, filed in the Republic of Korea on Jun. 26, 2019, all of which are hereby expressly incorporated by reference into the present application.

TECHNICAL FIELD

The present disclosure relates to attaching various structures to a wall using structures of a metal panel, which is attached to a wall surface, and a bracket.

BACKGROUND ART

FIG. 10 is an exploded perspective view of a bracket riveted to a wall and a shelf having the bracket as the background art. It is a bracket configuration view of an embodiment of a bracket riveted on a wall and a shelf having the bracket.

According to the embodiment of a bracket riveted on a wall and a shelf 10 having the bracket, a bracket 10 is coupled to a wall or a tile configured on a wall and serves to support the shelf 10 and a first support panel 60 is formed in a plate shape and inserted between the brackets 20 to support them.

The bracket 20 is installed on a wall and serves to support the first support panel 60. The bracket is formed to protrude at a predetermined part of the center, for example, in an '⊢' shape, and is made of a material such as aluminum, stainless steel, and reinforced aluminum to be able to be installed at a humid place such as a bathroom. It is preferable that the bracket is configured to maximally suppressing aging even due to long-time use.

The bracket 20 includes a fixing panel that is formed in a polygonal shape and installed on a wall, an insertion panel 40 that protrudes inward from a surface and to which an insertion groove 61 of the first support panel 60 is fitted, and a supporting protrusion 50 that forms a predetermined angle (a) between the fixing panel 30 and the wall.

The fixing panel 30 configured to be coupled to a wall is formed in a polygonal shape, for example, a rectangular shape and is installed and supports the weight of articles kept on the shelf 10. The fixing panel has a thickness of a predetermined level or more to support the weight of articles, and preferably, has a thickness of 3 mm to 10 mm.

Further, several fixing grooves 31 are formed with regular intervals at the upper part of the fixing panel 30 such that the fixing panel can be firmly coupled by inserting fixing members 33 such as screws or bolts, so the fixing panel can be firmly coupled by the wall fixing members 33.

Further, the length of the fixing panel 30 is smaller than the length of the first support panel 60 such that the bracket 20 is hidden inside the support panel 60 and aesthetic external appearance looks better.

The insertion panel 40 integrally formed at the middle part of the bracket 20 is configured to be inserted in the first support panel 60 such that the first support panel 60 can be supported. The insertion panel has a predetermined length to be able to sufficiently support the first support panel 60 and articles kept on the first support panel 60. A bonding groove 41 is formed at the upper part so that the insertion panel can be bonded by an adhesive such as a strong adhesive, a bond, a silicone to be firmly coupled when being inserted in the first support panel 60.

The bonding groove 41 configured at the upper end of the insertion panel 40 is a groove configured to be applied with an adhesive so that the first support panel 60 can be firmly coupled by the adhesive applied to the bonding groove 41 when being fitted on the insertion panel 40. The size of the bonding groove 41 is minimized so that the surface of the adhesive can directly come in contact with the first support panel 60.

A supporting protrusion 50, at which a protrusion is formed at the lower end of the fixing panel 30 such that the fixing panel 30 is inclined at a predetermined angle with respect to a wall, is configured to be inclined at a predetermined angle so that the shelf 10 can support the weight of articles for a long period of time and is configured such that a predetermined gap is formed when the supporting protrusion 50 and the fixing panel 30 are in close contact with a wall surface.

Further, since the supporting protrusion 50 is formed, it is preferable that the insertion panel 40 configured perpendicular to the fixing panel 30 is also inclined at the predetermined angle formed between a wall and the fixing panel 30, for example, at a predetermined angle the same as the inclination angle (a) formed between the fixing panel 30 and a wall.

Further, a fixing part 33 configured at the lower end of the part where the fixing panel 30 and the insertion panel 40 are coupled is configured to prevent damage to the bracket 20 even though the coupled part between the fixing panel 30 and the insertion panel 40 when the weight of articles on the first support panel 60 is biased to the fixing panel 30 due to the supporting protrusion 50 formed at the fixing panel 110.

However, this patent cannot achieve a non-support wall without any mark on a wall.

The present disclosure has been made in the following background.

DISCLOSURE

Technical Problem

A first subject is to implement a non-support shelf, etc. that naturally attaches various structures or articles on a wall using a metal panel.

A second subject is to enable various structures to be easily replaced on a wall by supporting various supports after separating a screw-fastened support by screw-fastening a protruding part of a support to a bottom support.

A third subject is to replace various structures through a straight support, a hooked support, and fixing part protruding from a meal panel.

Technical Solution

The following configuration is provided to solve the subjects described above.

There is provided a system wall for a building interior including:

- a wall part;
- a bracket that is attached to the wall part;
- a support that is attached to the bracket; and
- a hole-machined metal panel that corresponds to the support, in which a decoration part that is inserted in the support protruding from the hole-machined metal panel is configured.

In this case, it is preferable that protrusions are formed at an edge of the bracket so that the hole-machined metal panel is firmly inserted, a curved part is configured at an edge of the hole-machined metal panel, and holes corresponding to the protrusions are configured at the curved part.

In this case, it is preferable that the support is composed of a bottom support and a straight support, and the bottom support is similar to a space of the bracket and is inserted by forcible fitting.

In this case, it is preferable that the hole-machined metal panel is a metal panel at which a hole is machined to insert the protrusion of the support.

In this case, it is preferable that the decoration part is any one of a shelf part, a box part, and a hooked support.

In this case, it is more preferable that the decoration part is inserted and then the decoration part and the support are fixed by a fixing screw part.

In this case, it is preferable that the support is composed of a bottom support and a straight support, and the bottom support has bolt insertion parts.

In this case, it is preferable that the straight support is screw-fastened to the bottom support.

In this case, it is preferable that the support is composed of a bottom support and a hooked support, and the hooked support is screw-fastened to the bottom support.

In this case, it is preferable that the support is composed of a bottom support, a fixing part, and a fixing screw part.

In this case, it is preferable that the support has a shelf mounting hole.

In this case, it is preferable that the bottom support has an anti-rotation key groove to insert an anti-rotation key.

Advantageous Effects

A first effect is to implement a non-support shelf, etc. that naturally attaches various structures or articles on a wall using a metal panel.

A second effect is to enable various structures to be easily replaced on a wall by supporting various supports after separating a screw-fastened support by screw-fastening a protruding part of a support to a bottom support.

A third effect is to replace various structures through a straight support, a hooked support, and fixing part protruding from a meal panel.

BEST MODE

Description referring to FIGS. 8 to 9 is as follows.

Three kinds can be connected in a bolt type to a main body connected to a bracket.

Figure 8A:
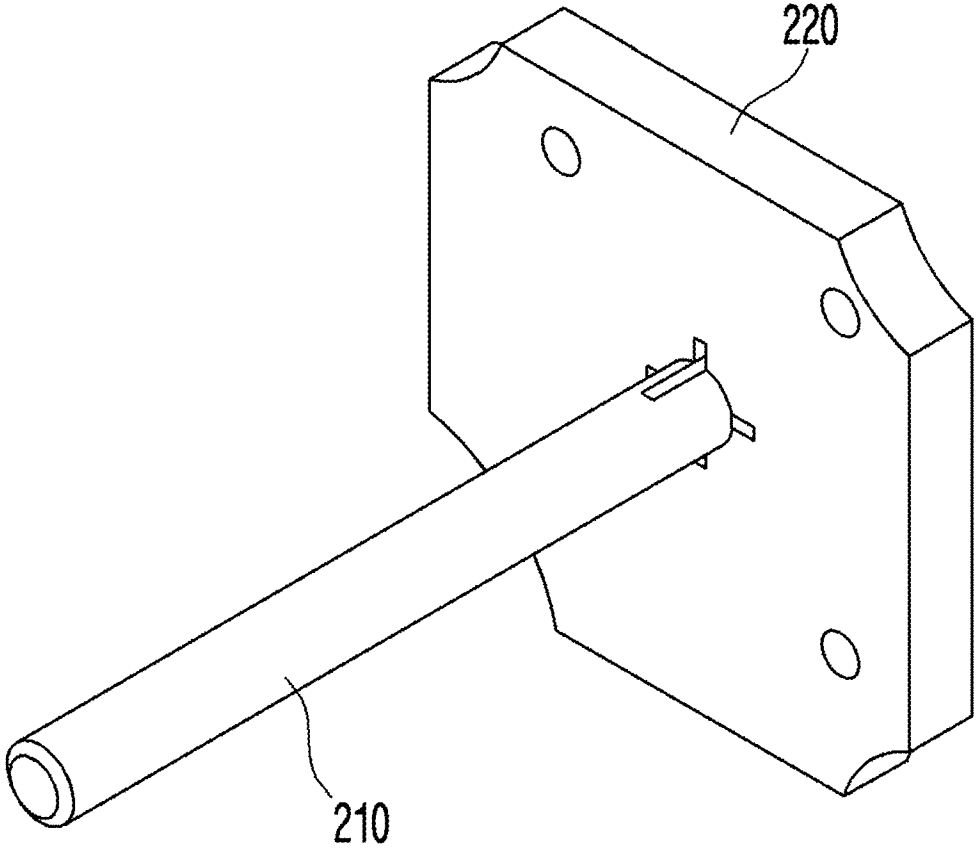
FIG. 8*a* is a view showing an anti-rotation key groove in FIG. 2*b*.
Figure 9A:
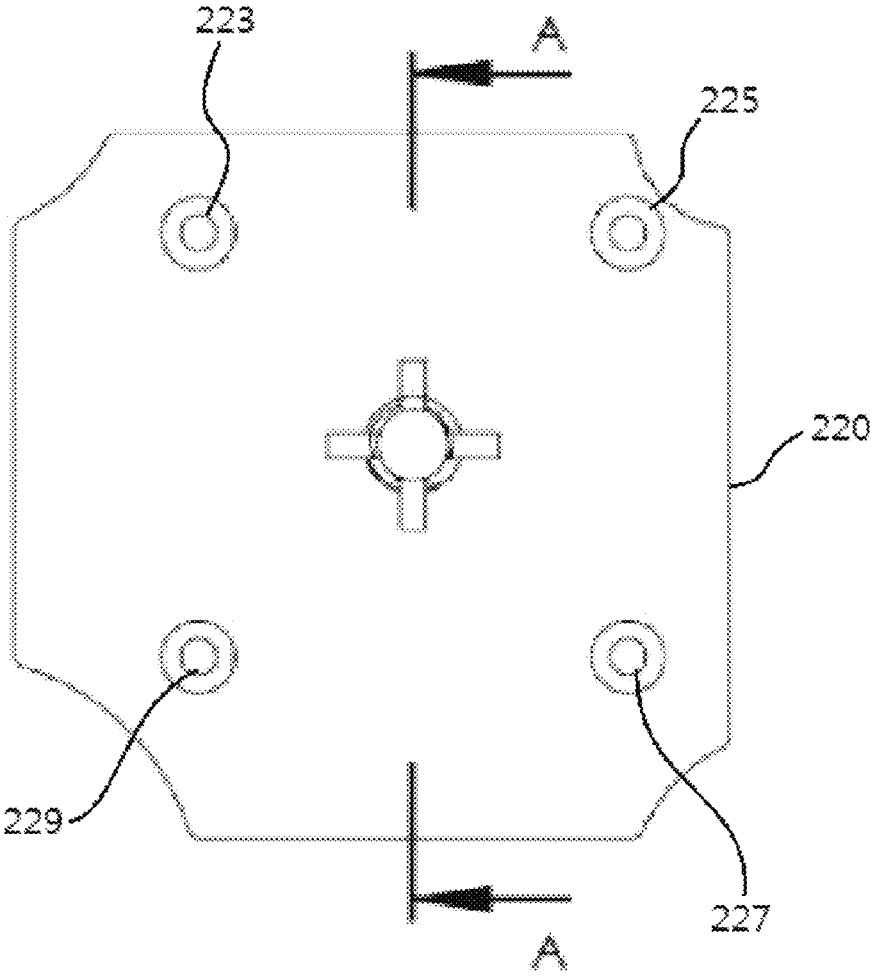
FIG. 9*a* is a view showing the configuration of a bottom support.
Figure 9B:
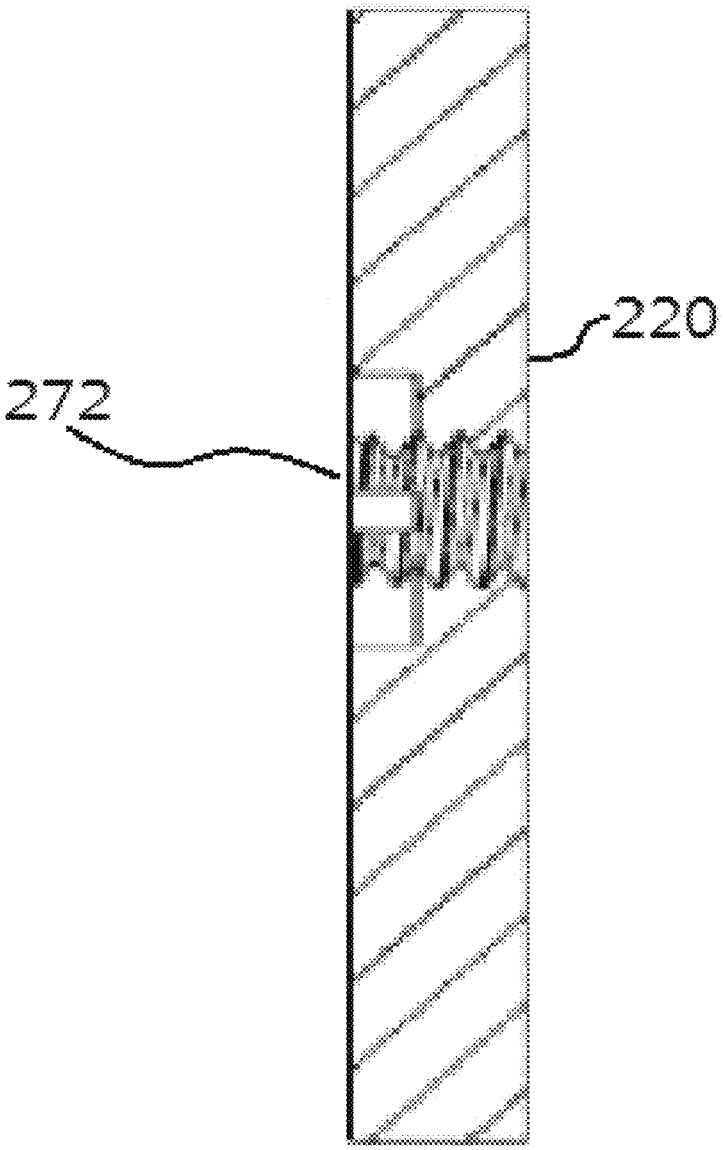
FIG. 9*b* is a cross-sectional view of an A-A' surface of FIG. 9*a*.

FIG. 8*a* is a view showing an anti-rotation key groove 272 in FIG. 9*b*.

Existing non-support shelves can be fixed. The anti-rotation key groove 272 is configured to prevent a straight support 210 from being rotated and loosened.

Figure 8B:
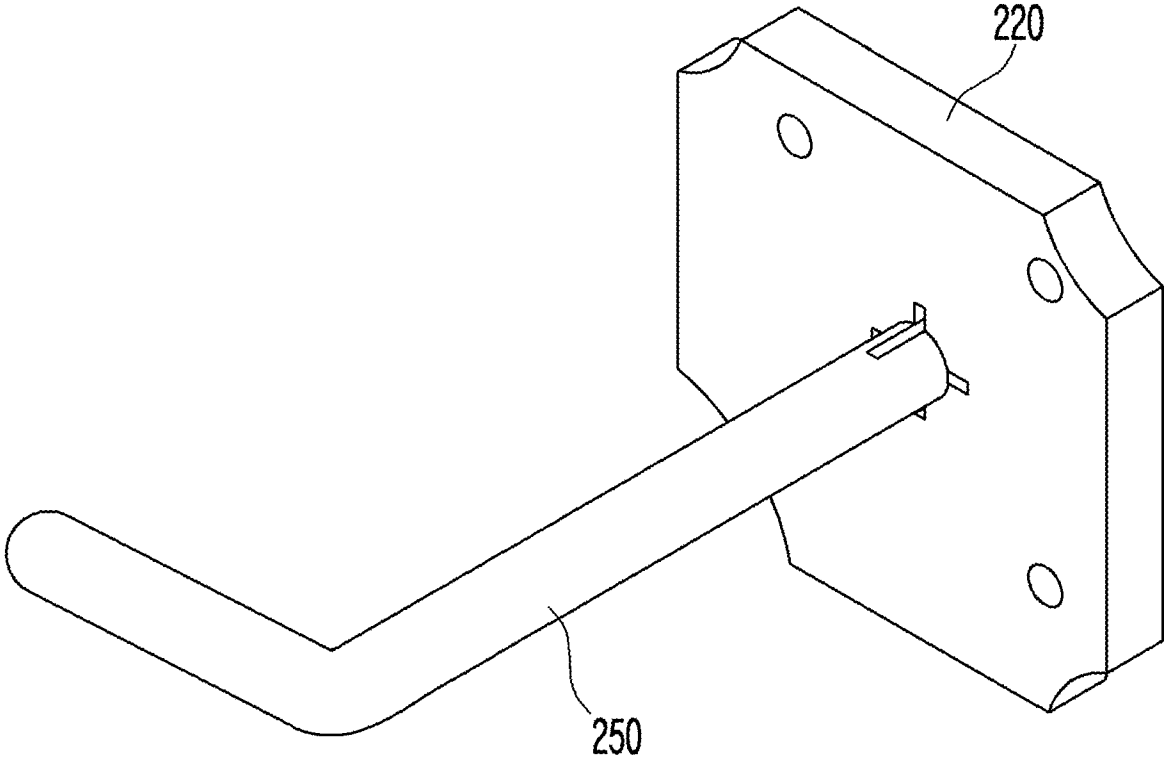
FIG. 8*b* is a view showing that a hooked support is applied.

FIG. 8B is a view showing that a hooked support is applied.

FIG. 8B is a hanger on which clothing or hats can be hung.

Figure 8C:
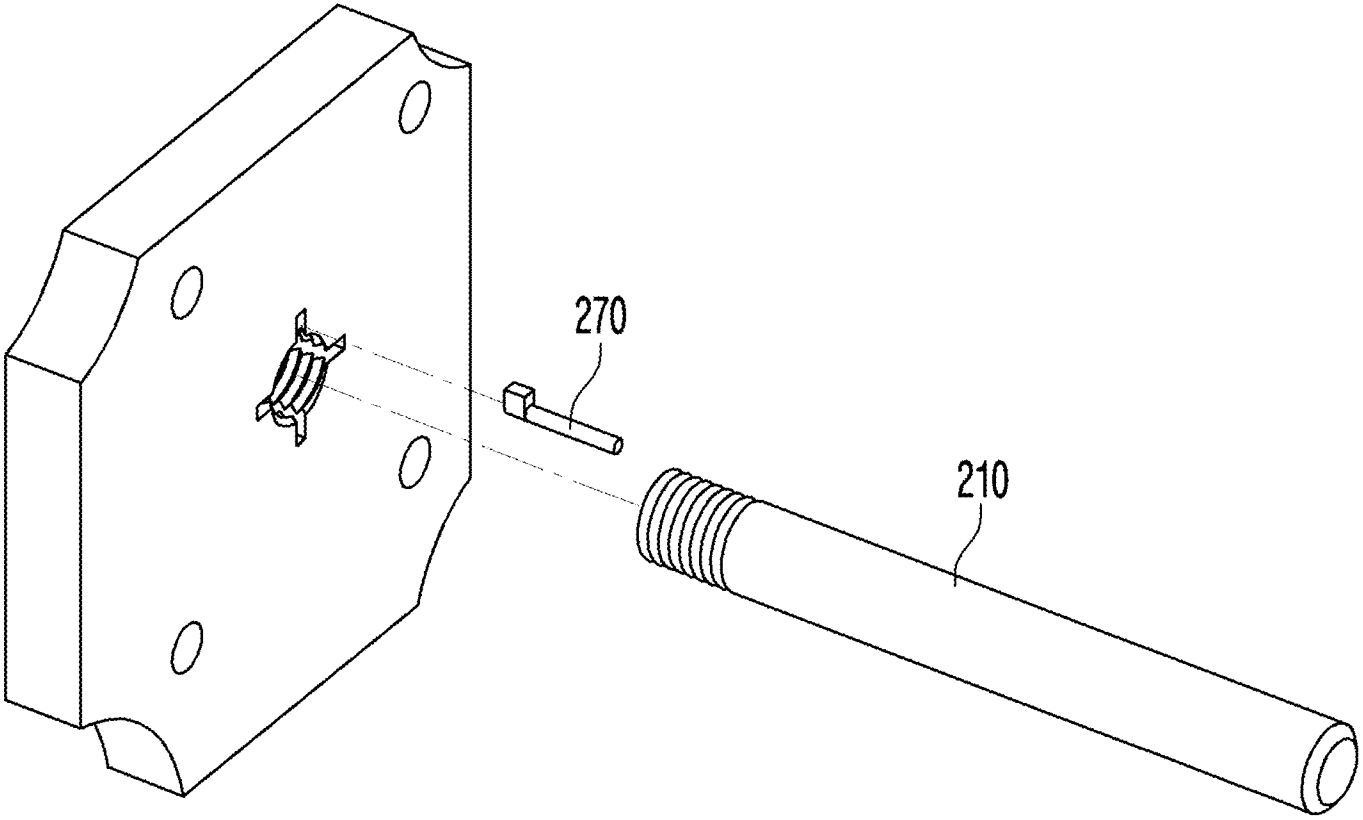
FIG. 8*c* is a view showing separation of FIG. 8*a*.

FIG. 8*c* is a view showing separation of FIG. 8*a*.

Although it is configured in a straight type, the straight support 210 and the hooked support 250 are screw-fastened to be able to be simply tightened and loosened by rotation for replacement with each other.

Figure 8D:
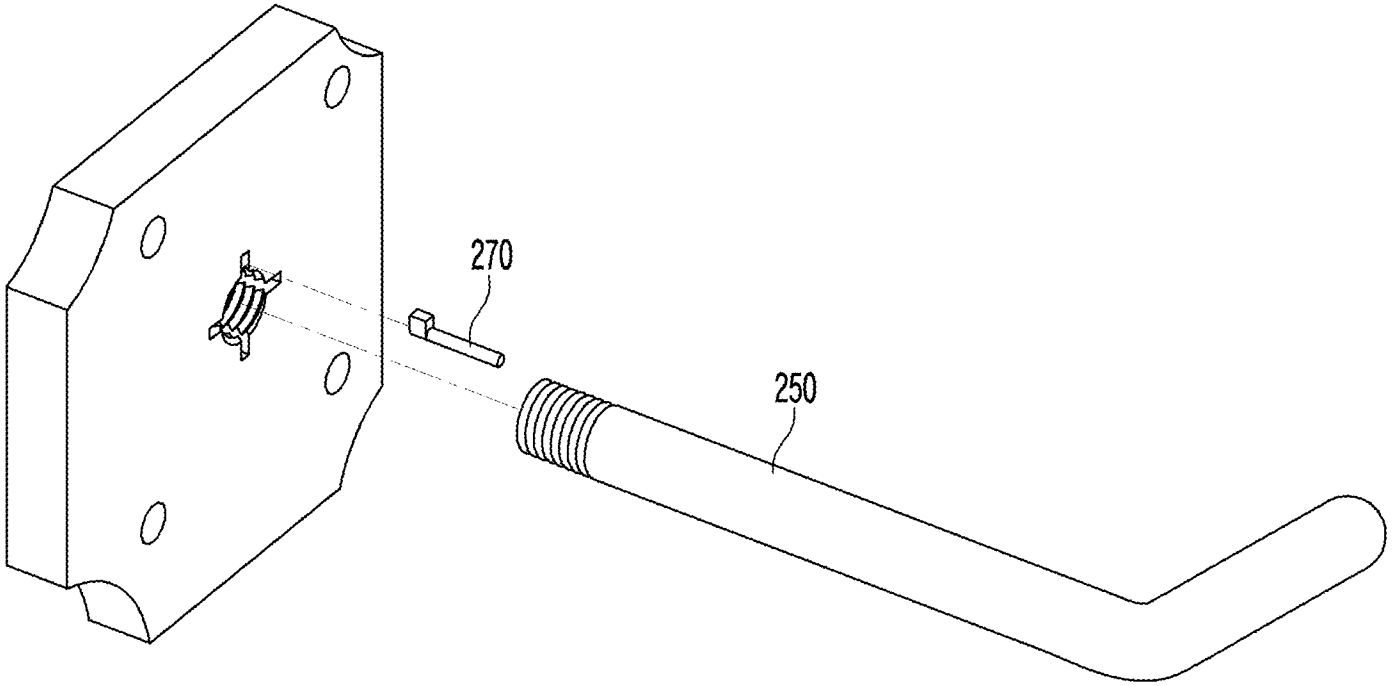
FIG. 8*d* is a view showing separation of FIG. 8*b*.

FIG. 8*d* is a view showing separation of FIG. 8*b*.

An anti-rotation key 270 is configured to prevent loosening by prevent rotation of the support.

Figure 8E:
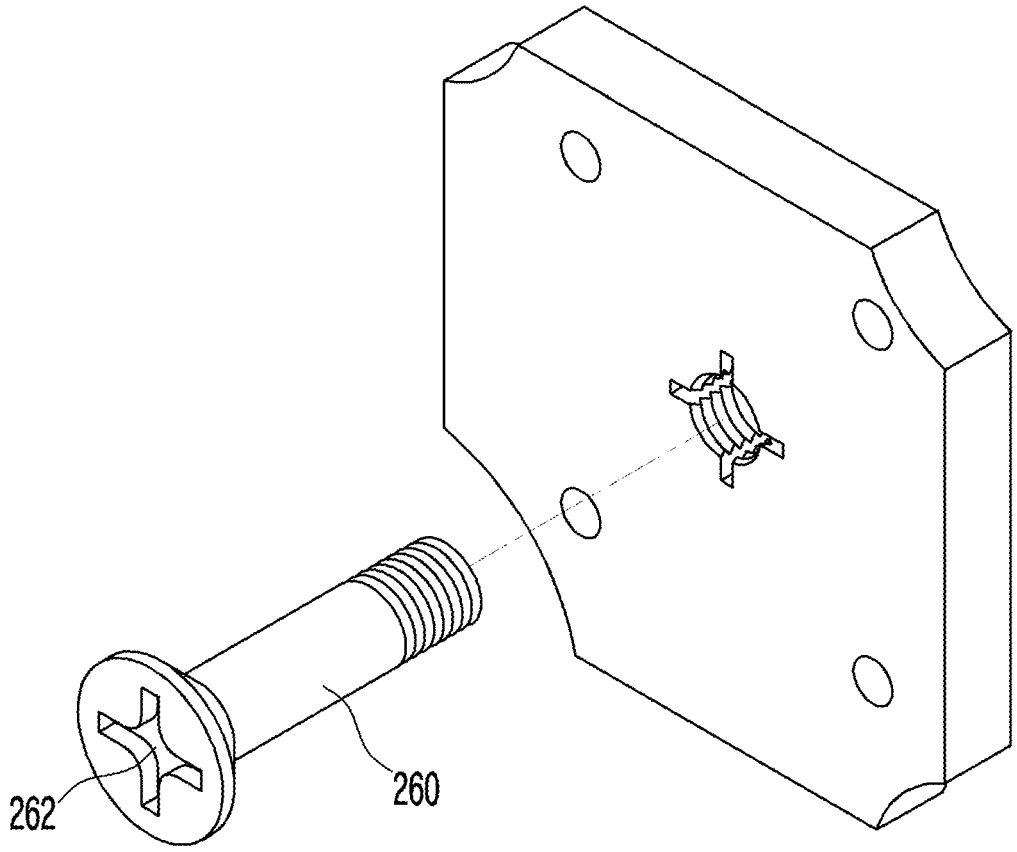
FIG. 8*e* is a view showing a fixing part and fixing screw part.

FIG. 8*e* shows a fixing part 260 and a fixing screw part 262.

It functions as a nut or a bolt that can fix other structures.

It is possible to couple the part of the bottom support 220 and a seat for fixing on various types of supports, a simple support, a hanger, and a wall.

FIG. 9*a* is a view showing the configuration of a bottom support.

FIG. 9*b* is a view showing an A-A' cross-section of FIG. 9*a* of the bottom support.

Separate bolt insertion parts 223, 225, 227, and 229 are configured at the bottom support 220.

It is possible to insert it in a space of a bracket without a separate fastening hole, but it is preferable to configure a separate fastening hole in order to support much weight.

Figure 9C:
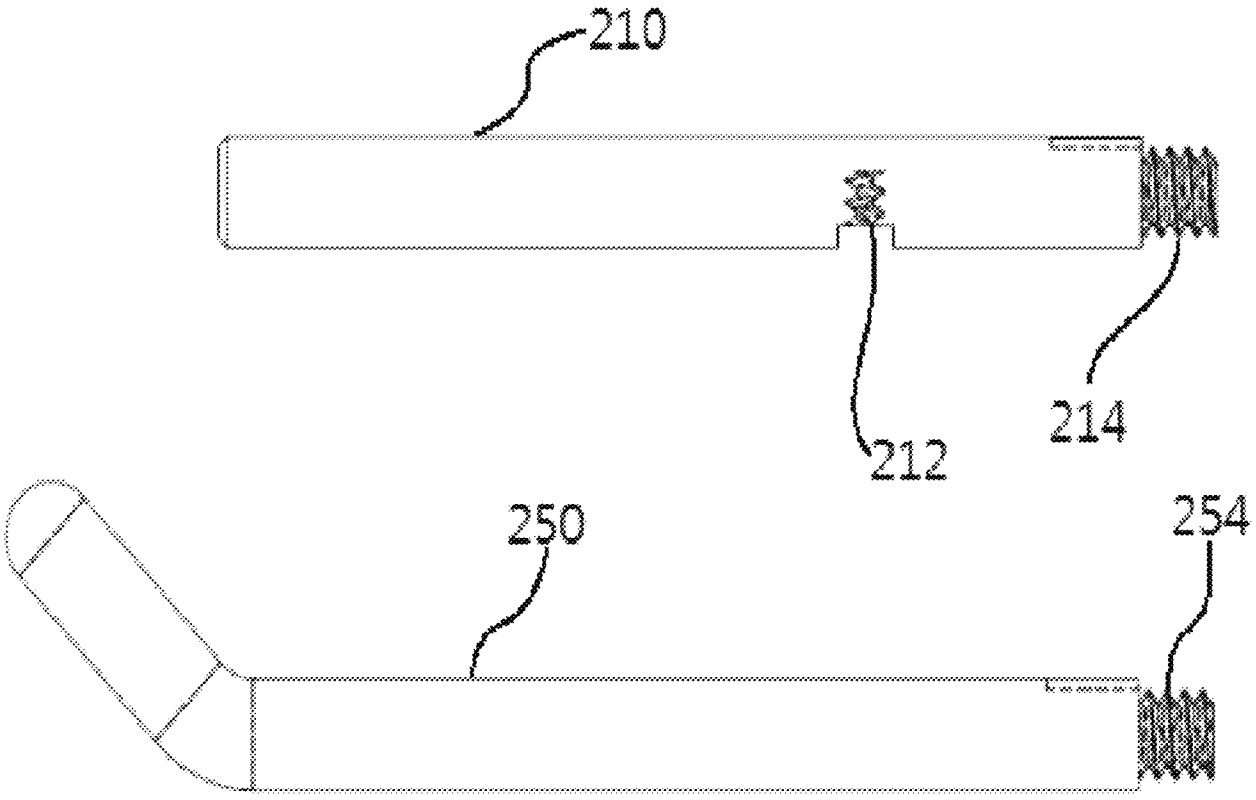
FIG. 9*c* is a view showing that a shelf mounting hole is configured at a straight support and a hook support.
Figure 10:
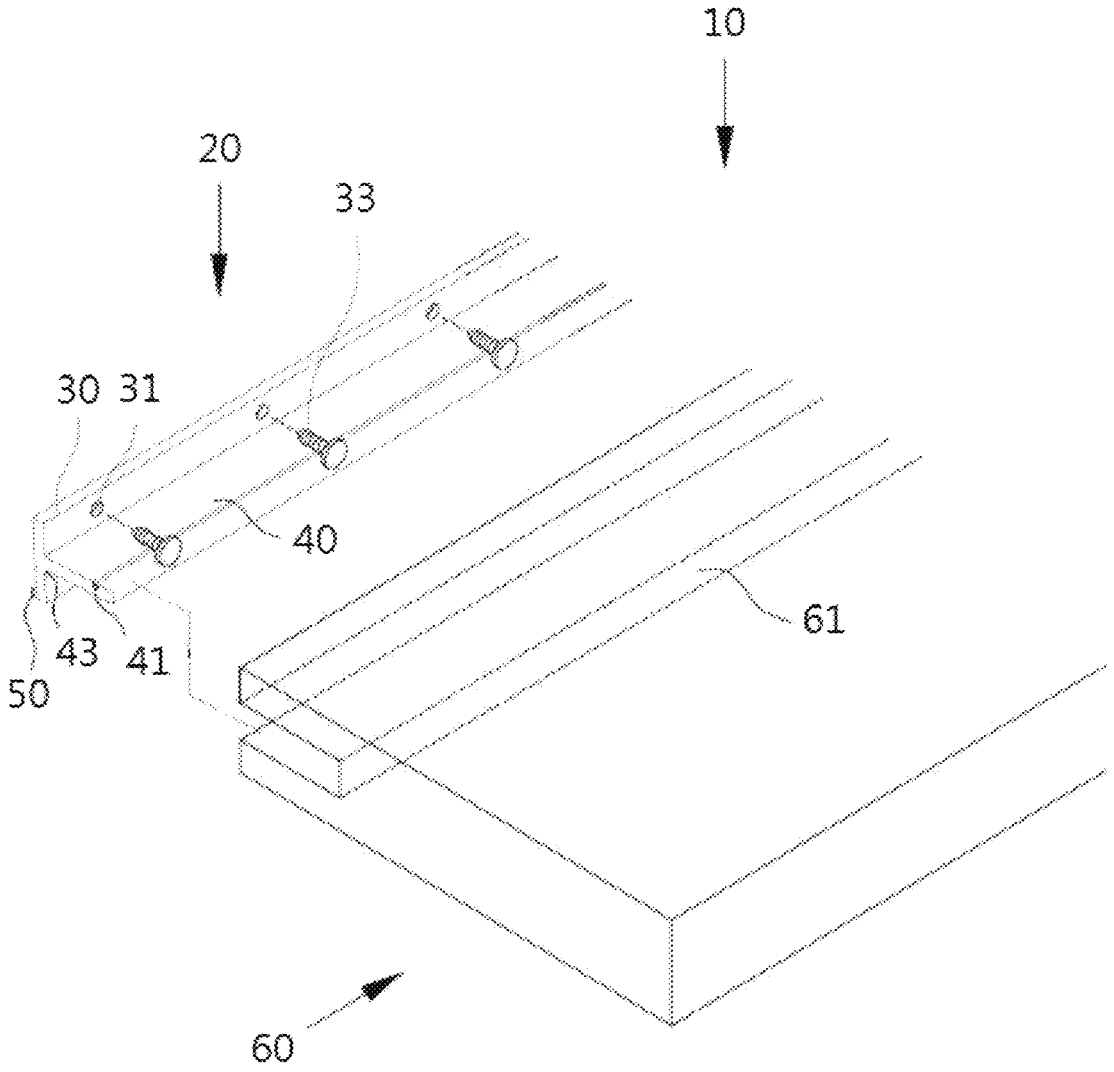
FIG. 10 Conventional Art
FIG. 10 is a view showing the related art.

FIG. 9*c* is a view showing that a shelf mounting hole 212 is configured at a straight support.

The shelf mounting hole is configured to prevent a shelf from separating from a support when the shelf is inserted and an earthquake occurs or a wall is inclined inward.

Coupling screw parts 214 and 254 are configured to couple the bottom support 220.

The support 200 is composed of the bottom support 220 and the straight support 210 and it is preferable that bolt insertion parts 223, 225, 227, and 229 are configured at the bottom support 220.

It is preferable that the straight support 210 is configured to be screw-fastened to the bottom support 220.

The support 200 is composed of the bottom support 220 and the hooked support 250 and it is preferable that the bottom support 220 and the hooked support 250 are configured to be screw-fastened.

It is preferable that the support 200 is composed of the bottom support 220, the fixing part 260, and the fixing screw part 262.

It is preferable that the support 200 has the shelf mounting hole 212.

The fixing screw part 520 is inserted in the shelf mounting hole 212 so that the support 200 and a decoration part 400 including a shelf part 410 and a box part 420 are not separated forward.

It is preferable to configure the anti-rotation key groove 272 at the bottom support 220 in order to insert the anti-rotation key 270.

MODE FOR INVENTION

The present disclosure is to conveniently install and mount a decoration part including a shelf, etc. by configuring a support using a structure of a metal tile and a bracket for attaching the metal tile to a wall surface.

As a construction method, a bracket connecting a wall and a tile is constructed on a wall surface, a structure such as a support suitable for the purpose is installed in a spare space of the bracket, and it is inserted in an insertion hole configured at a metal tile such that the support and the structure can protrude.

Further, it is also possible to change the bracket in various structures to construct a desired structure on a wall surface.

The application kinds are as follows.

Structures such as various hangers, shelves, and drawers and various decoration parts are attached to a wall.

That is, the physical structure for receiving various hangers, shelves, drawers, etc. is as follows.

A bottom support of an accessory having a hanger shape is attached in the spare space of the bracket such that the accessory can protrude over it and the metal tile having a corresponding hole is assembled.

1) A hanging structure that can hang picture frames, hats, clothing, etc.

2) A structure that can fix shelves, drawers, etc. and that can be applied to shelves without a support, drawers without a support, etc.

The term 'without a support' means that a support is inserted in the shelf or drawer such that the shelf or drawer is shown like there is no support.

A plurality of hooks is configured between the bracket and the metal tile.

In the present disclosure, 24 hooks are configured for each unit metal tile.

A shelf that applies a considerable weight can be sufficiently supported on a wall by the hooks.

There is an advantage that when it is required to replace a part of the metal tile, it is possible to change the interior atmosphere at any time by replacing the attached metal tile through the structure that is easy to attach/detach the metal tile because of the hooks.

It may be possible to reassemble another tile having a different design by separating the assembled tile, and if necessary, it is possible to freely install and remove shelves or various hangers on and from a wall surface.

The metal tile may have a hole configured to have a corresponding configuration such that a support for supporting a shelf or a hanger is inserted. A hole is machined at the tile such that a support that can commonly support various shelves or hangers having different shapes or functions.

It is possible to fix and install shelves or various hangers on the support.

According to the present disclosure, a bracket is configured on a wall surface, a support is fixed in the space of the bracket, a metal plate having a hole at the position corresponding to the support is inserted, and the support is coupled to an insertion hole in which a support is inserted and that is configured at a shelf Detailed configuration is described with reference to FIGS. 1 to 6.

A bracket 100 that is attached to a wall part 600 is attached to a wall part 600 by the fixing screw part 510.

The support 200 is attached to the bracket 100.

A hole-machined metal panel 300 corresponding to the support 200 is attached.

A system wall is configured by configuring decoration part 410 and 420 that are inserted in the support 200 protruding from the hole-machined metal panel 300.

Protrusions are formed at an edge of the bracket 100 such that the hole-machined metal panel 300 is firmly inserted, a curved part is configured at an edge of the hole-machined metal panel 300, and holes corresponding to the protrusions are configured at the curved part.

Figure 4:
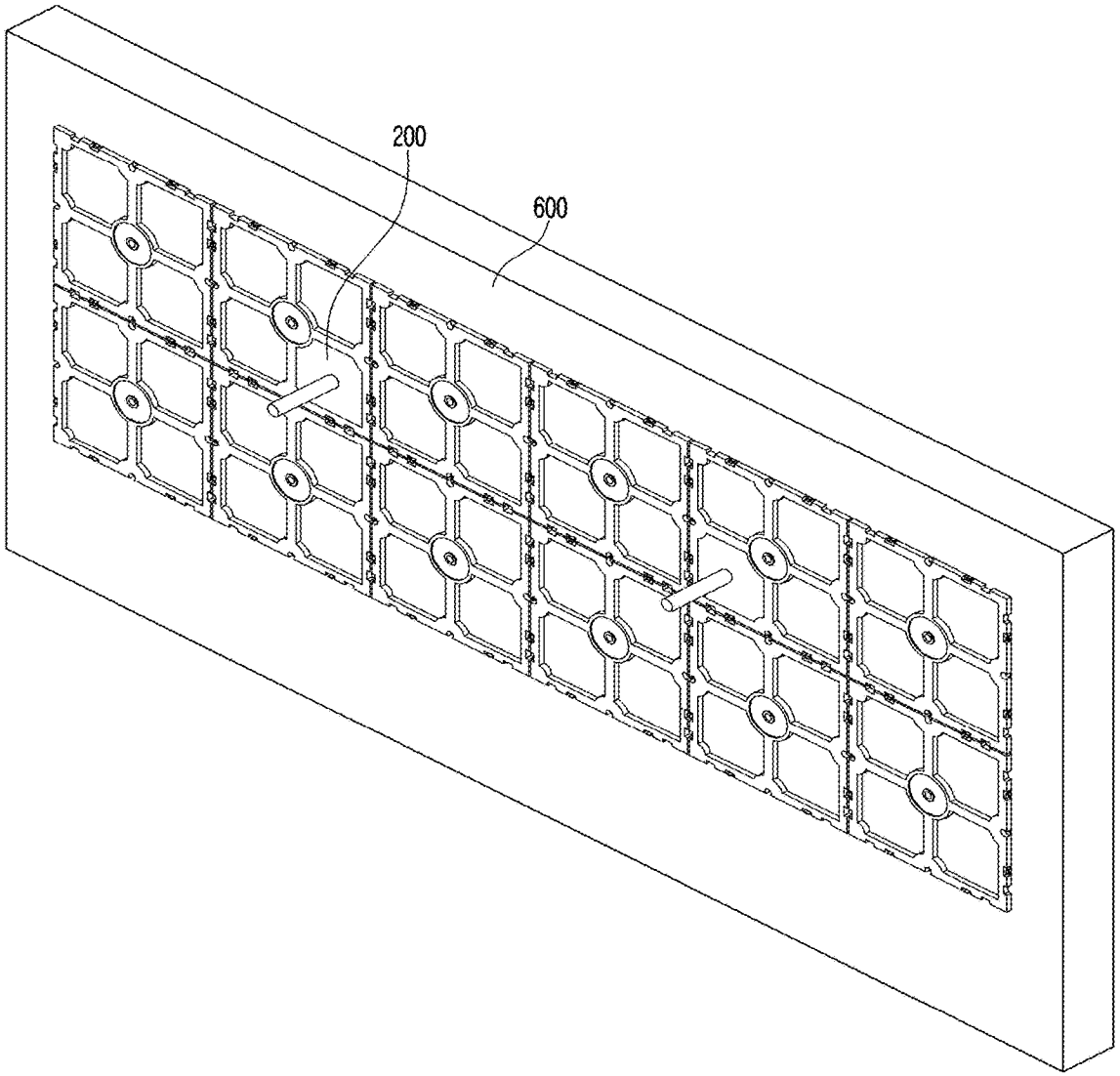
FIG. 4 is a view showing that a support is inserted in FIG. 3.
Figure 5A:
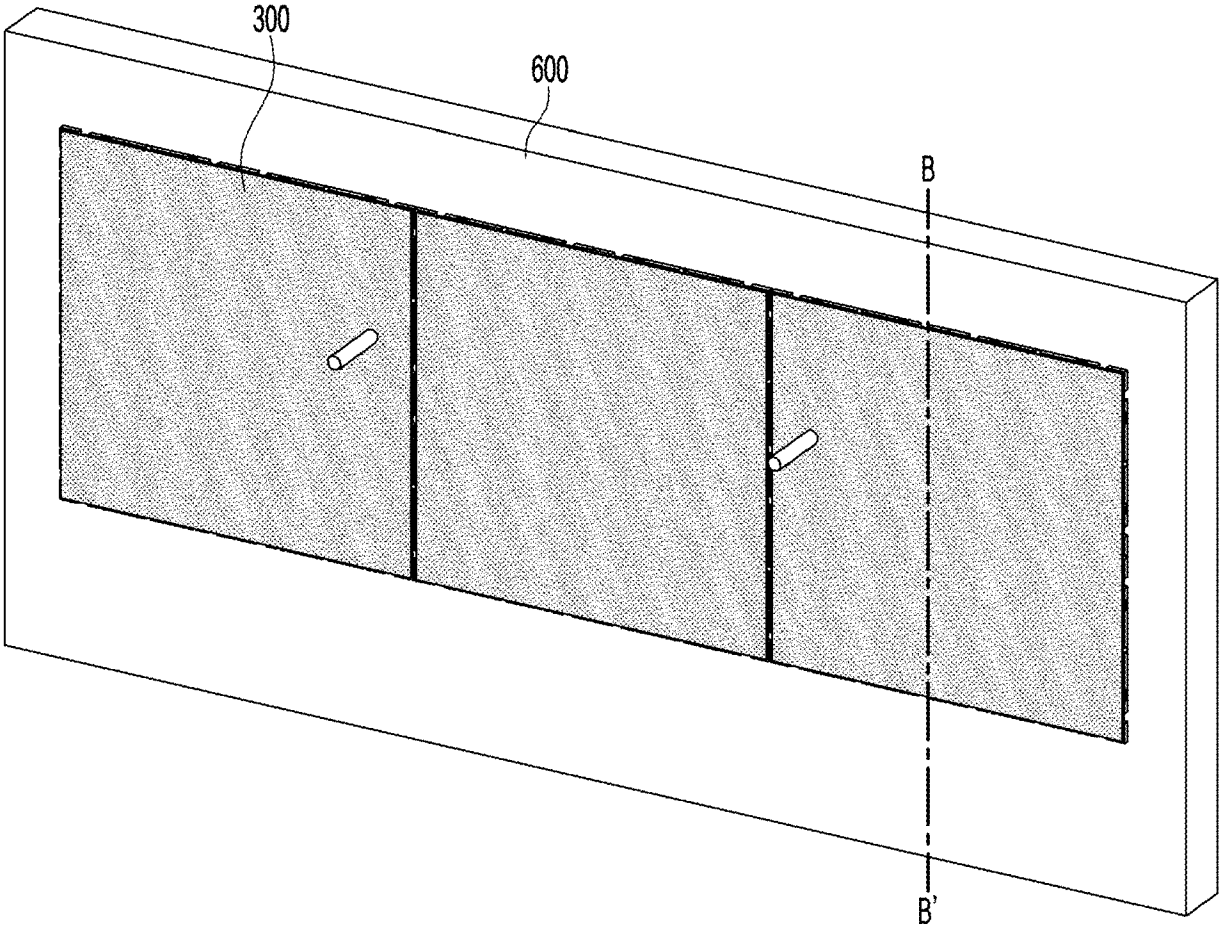
FIG. 5*a* is a view showing that a hole-machined metal panel is inserted in FIG. 4.
Figure 5B:
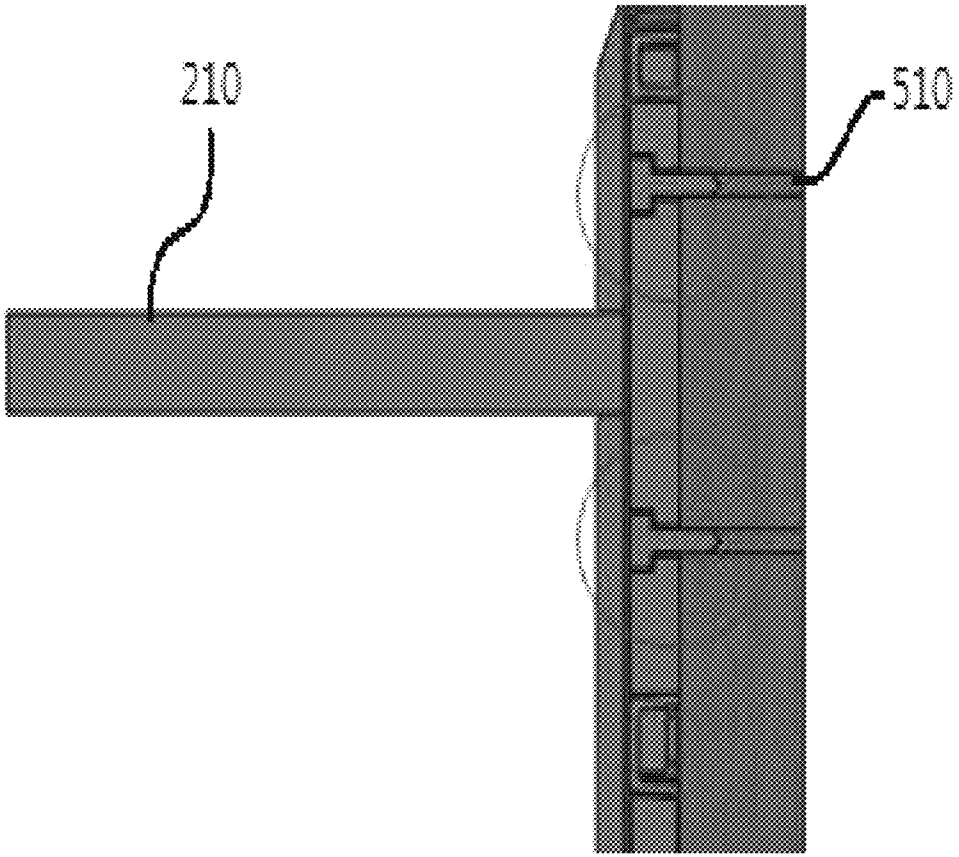
FIG. 5*b* is a view showing a cross-section of FIG. 5*a*.
Figure 6A:
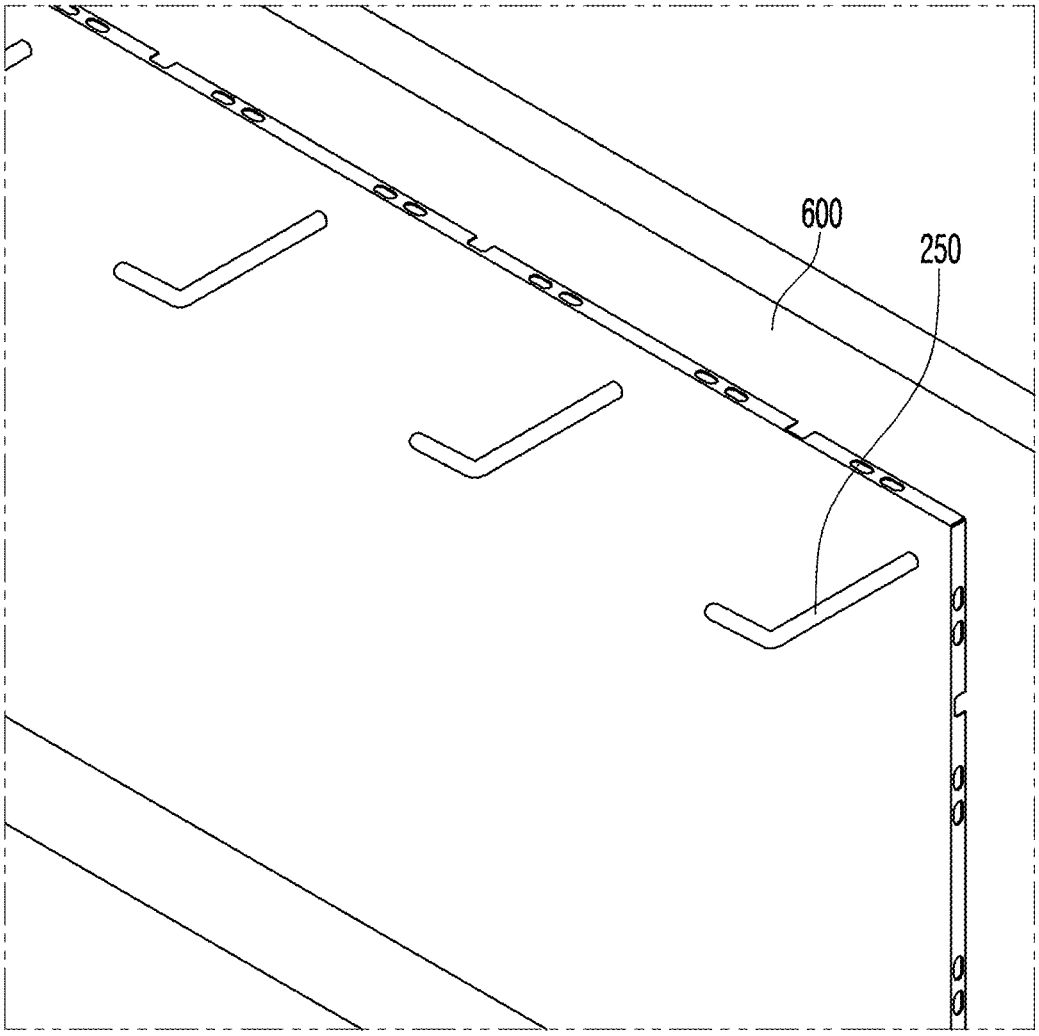
FIG. 6*a* is a view showing that a hooked support is attached to a wall.
Figure 6B:
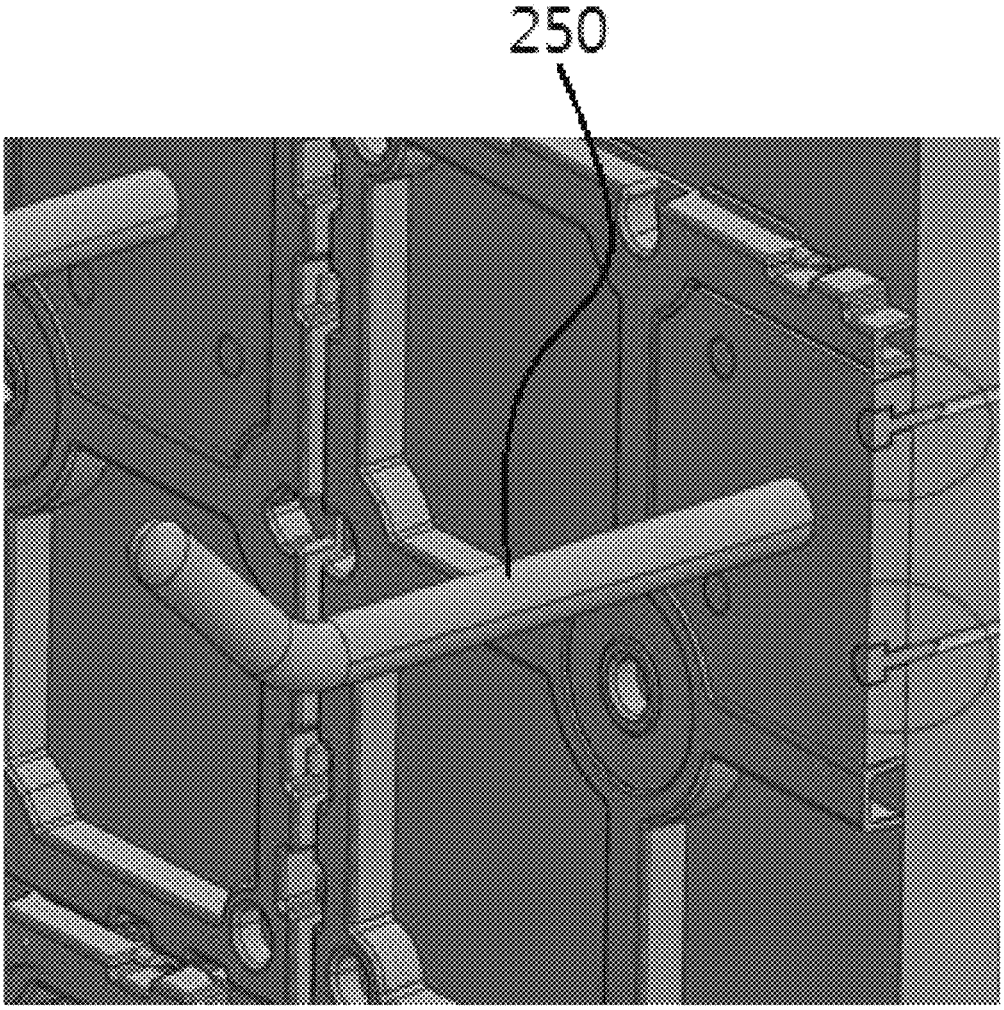
FIG. 6*b* is a view showing a configuration before a hole-machined metal panel is fitted on a hooked support.

The support 200 is composed of the bottom support 220 and the straight support 210, and the bottom support 220 is a similar configuration to the space 120 of the bracket 100 and has only to be inserted by forcible fitting. The shape of the bottom support 220 is configured fittingly corresponding to a central contour 122 in a way that the bottom support 220 is inserted by forcible fitting into the space 120 between ribs 124, 126 and 128 of the bracket. In other words, a central edge 222 is configured in order to make proper insertion into the central contour 122 of the bracket, and peripheral edges 224, 226 and 228 are configured in order to make proper insertion into the other contours of the bracket. FIG. 4 and FIG. 6*b* show how the support is inserted into the space 120 of the bracket.

Of course, the bottom support 220 may be separately inserted in the bolt insertion parts 223, 225, 227, and 229 on a wall plate.

In this case, the support can support much weight.

The hole-machined metal panel 300 is configured as a hole-machined metal panel to insert the protrusions of the support 200.

Figure 1A:
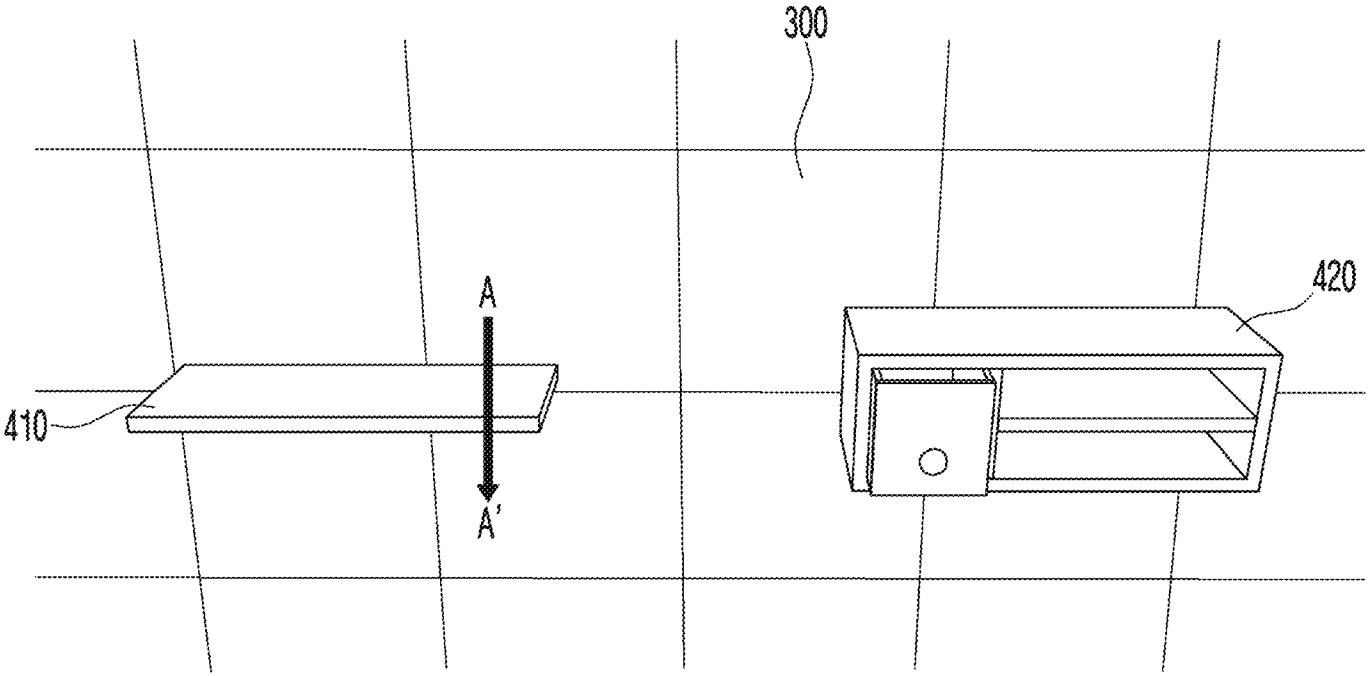
FIG. 1*a* is a view showing that a shelf part and a box part are attached to a hole-machined metal panel.
Figure 1B:
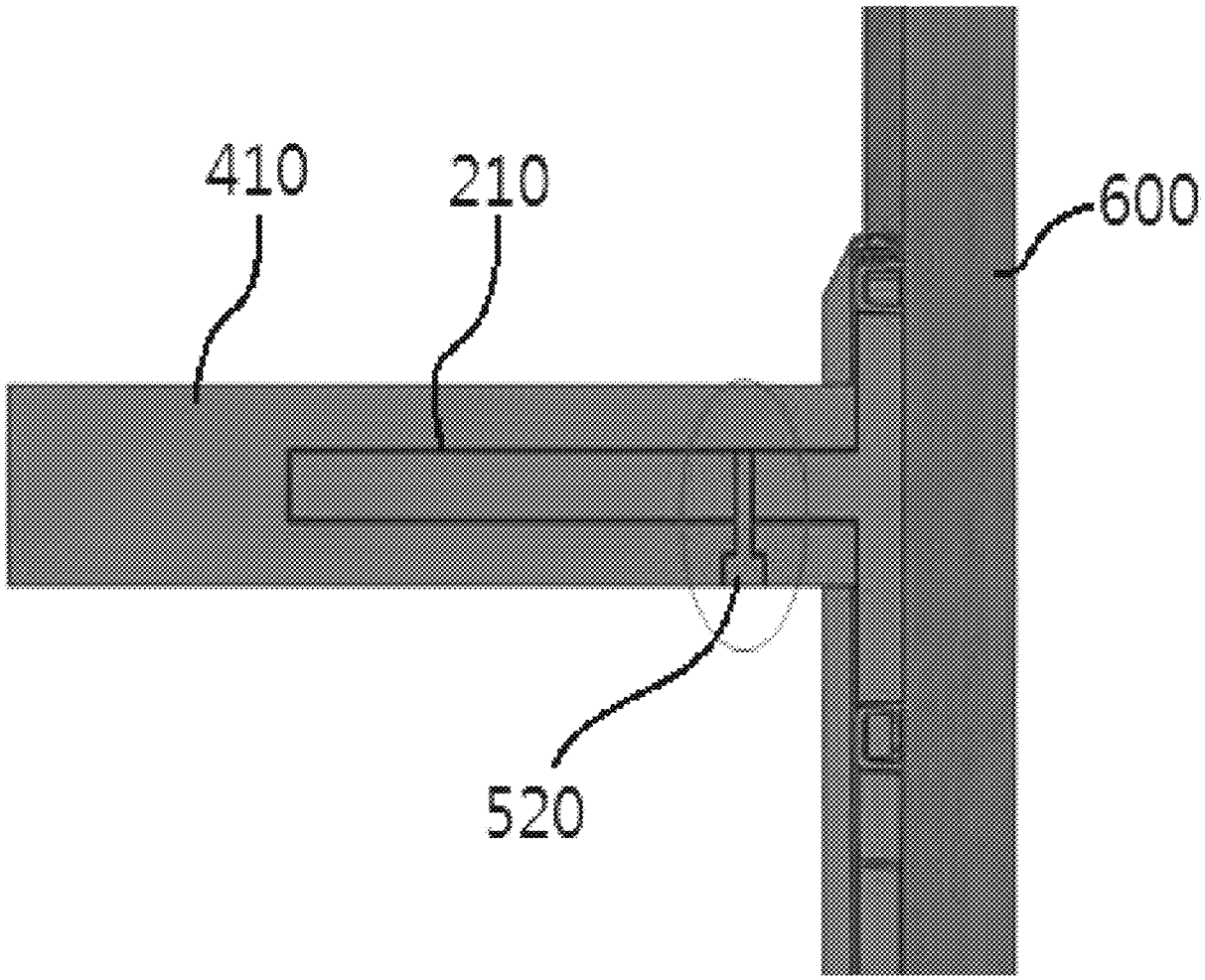
FIG. 1*b* is a cross-sectional view taken along A-A' of FIG. 1*a*.
Figure 2A:
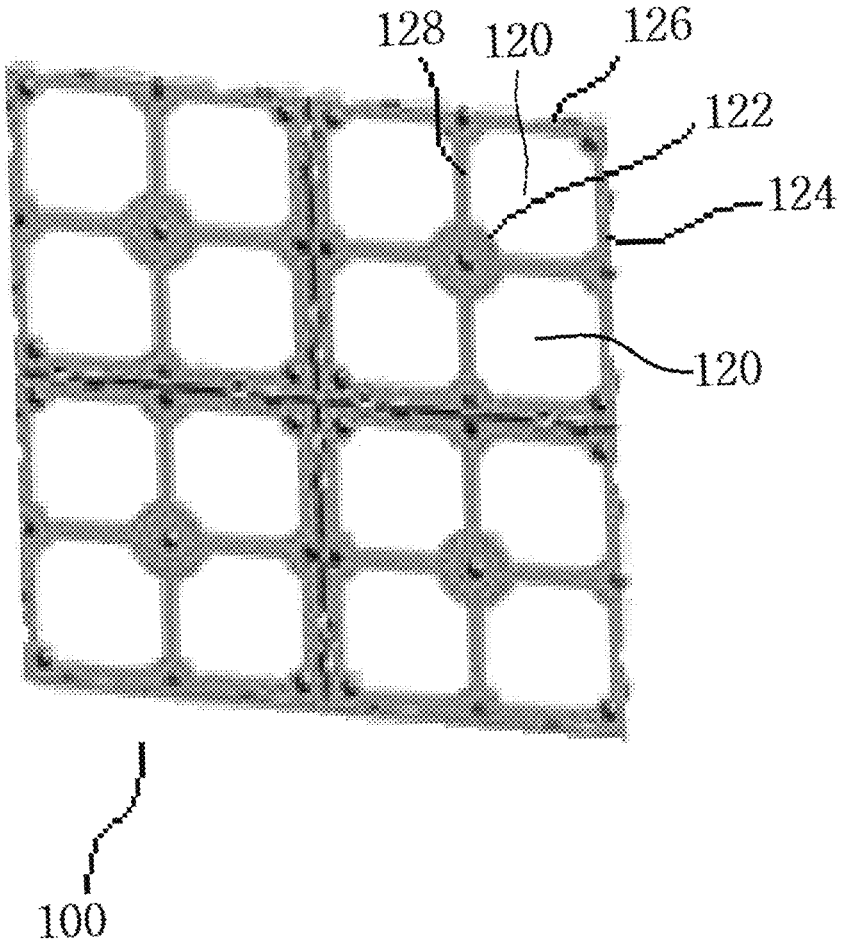
FIGS. 2*a* to 2*f* are views showing parts of FIGS. 1*a* and 1*b*.
Figure 2B:
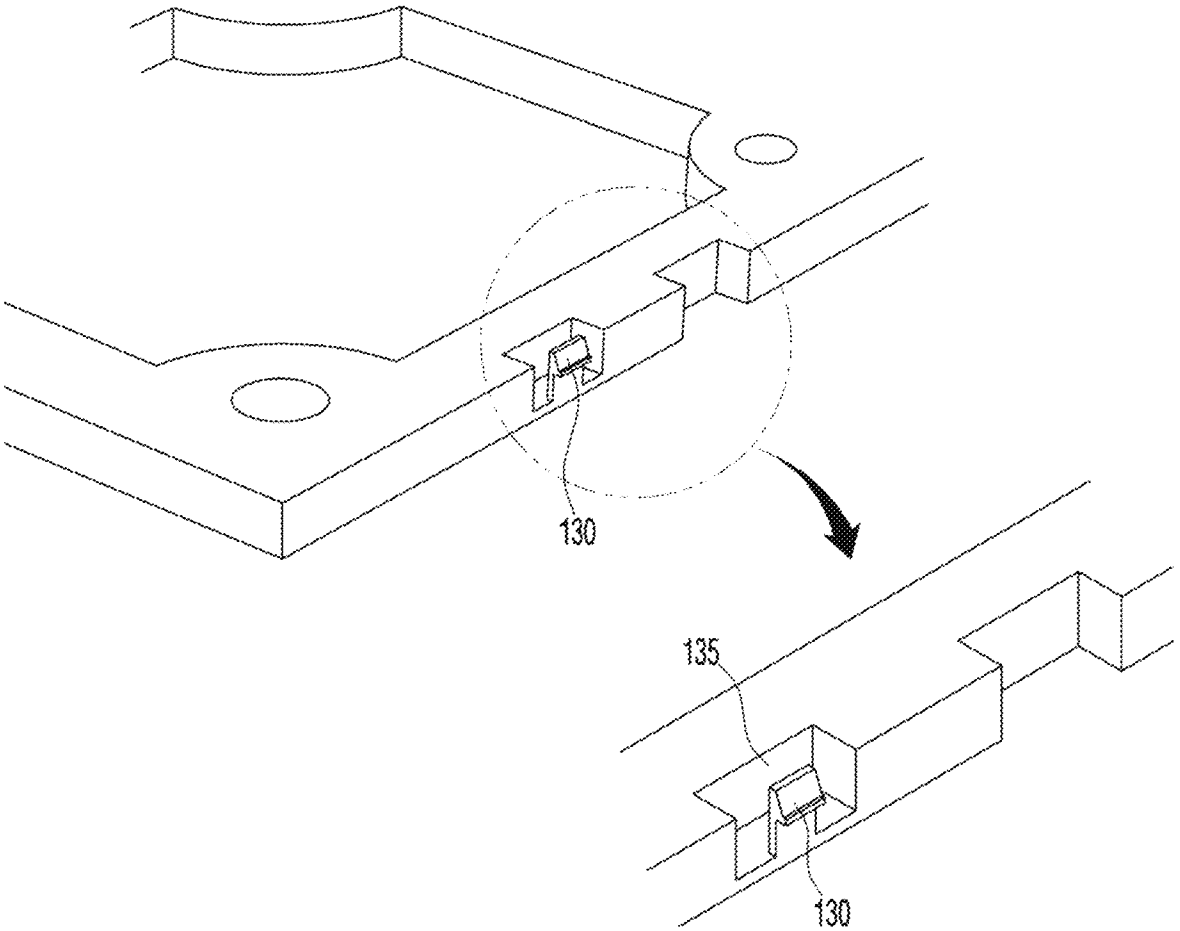
Figure 2C:
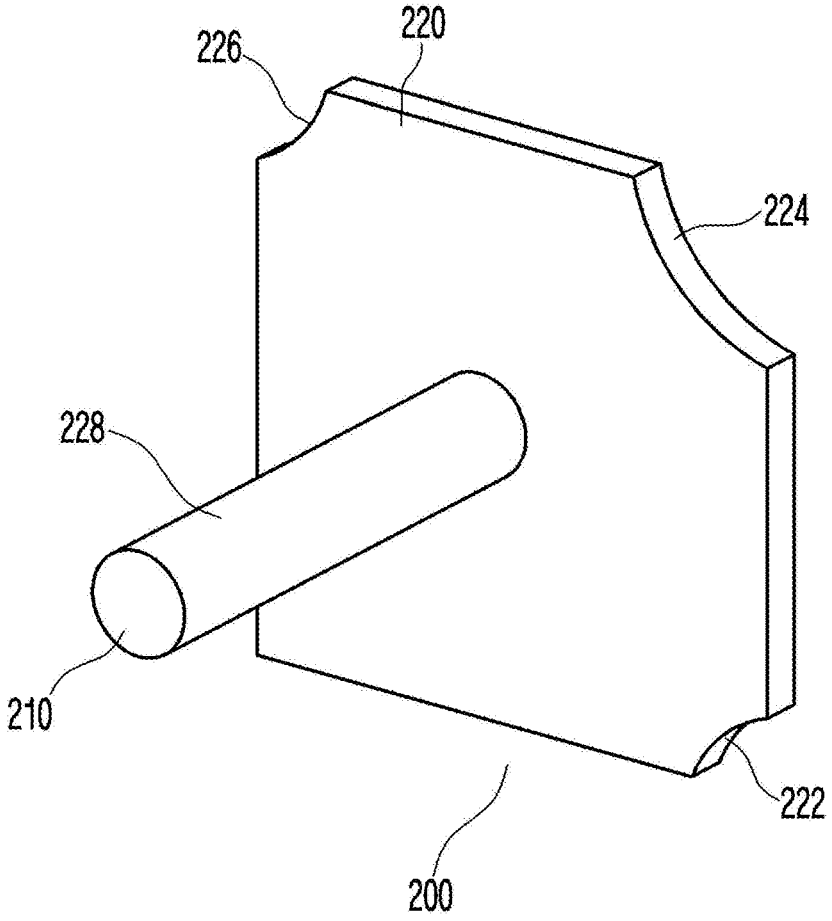
Figure 2D:
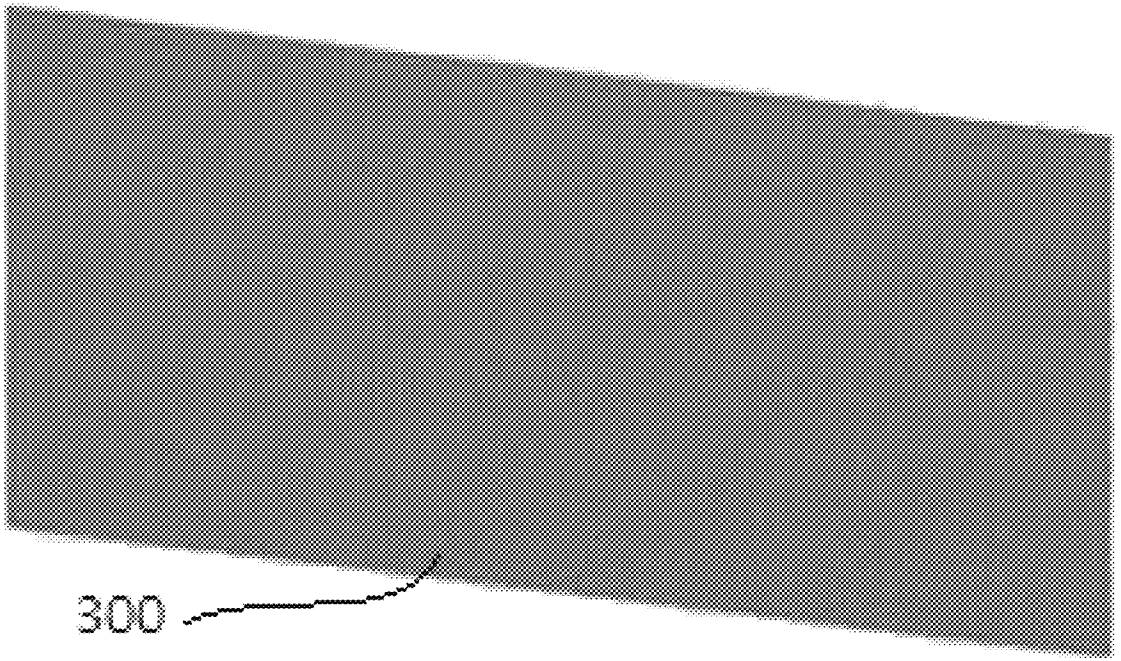

As shown in FIG. 2*b*, a coupling avoidance space 135 is configured on the rear surface of the coupling protrusion 130 so that a hole-machined metal panel 300 can be coupled well through the coupling avoidance space.

Figure 2E:
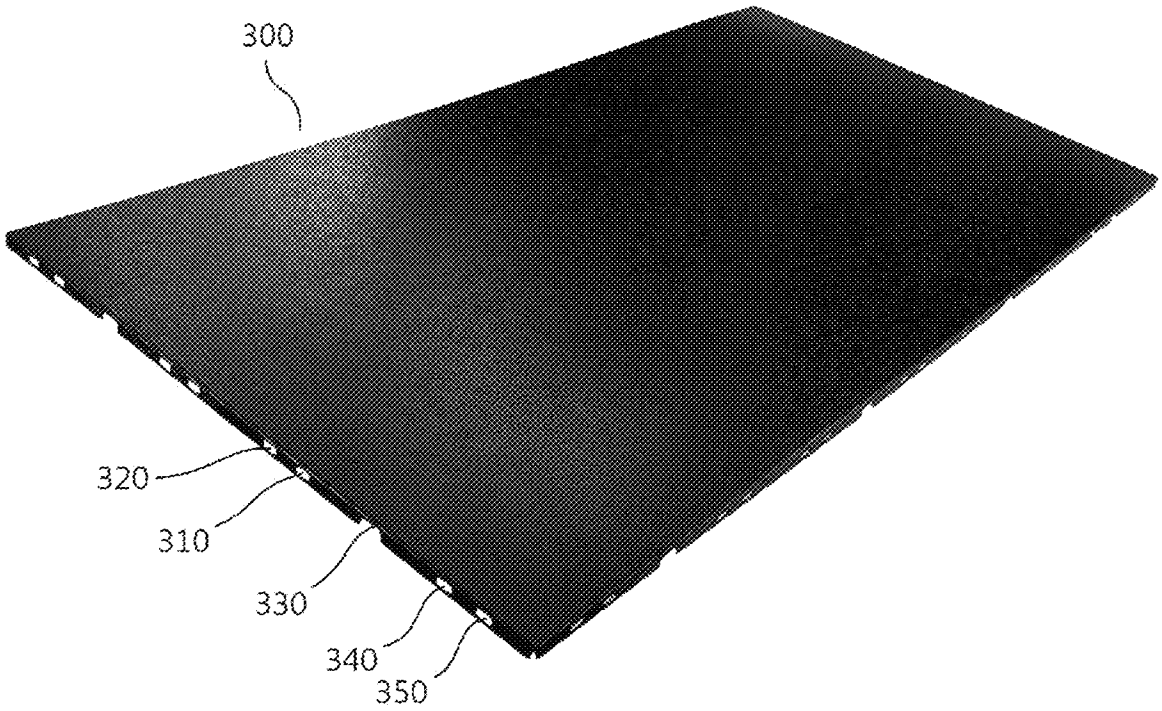
Figure 2F:
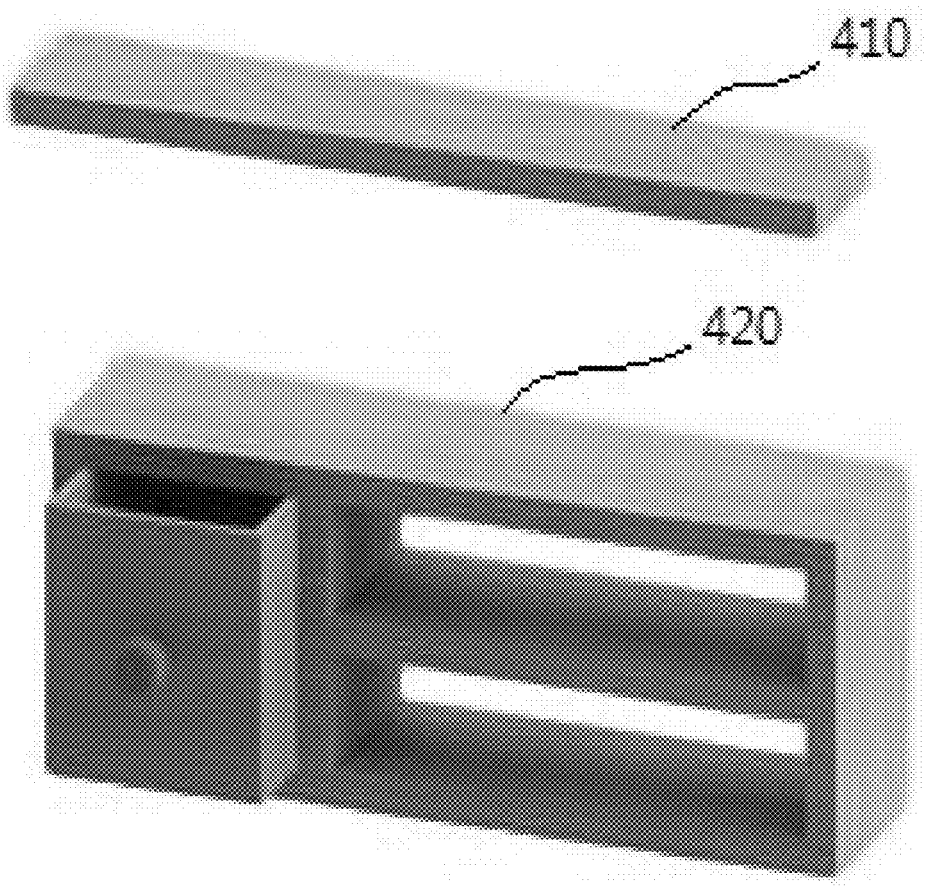
Figure 3:
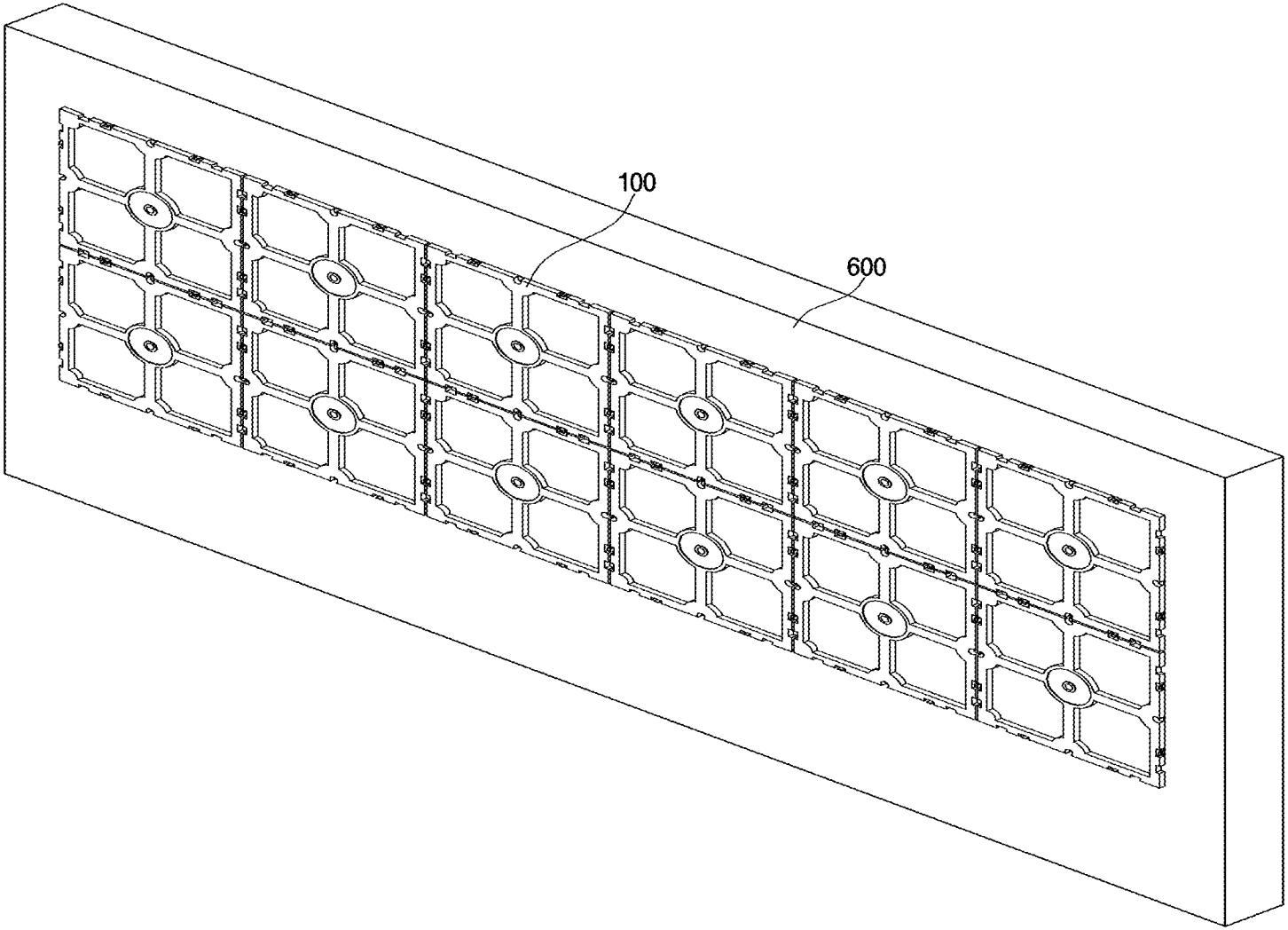
FIG. 3 is a view showing that a bracket is attached to a wall.

FIG. 2*e* is described hereafter.

Coupling protrusion holes 310, 320, 340, and 350 are formed at the hole-machined metal panel 300 that is coupled to the coupling protrusions 130, and connection part holes 330 corresponding to connectors (not shown) inserted in the connection part grooves are formed at the hole-machined metal panel.

It is preferable that two protrusion holes 310, 320, 340, and 350 are formed at the left and right of the connection part hole 330.

According to this configuration, it is possible to resist desired load by coupling of the hole-machined metal panel and the bracket even the support is simply forcibly fitted in the space of the bracket.

The decoration parts 410 and 420 are configured as any one of the shelf part 410, the box part 420, and the hooked support 250.

It is preferable to insert the decoration parts 410 and 420 and then fix the decoration parts 410 and 420 and the support 200 with the fixing screw part 520.

Figure 7A:
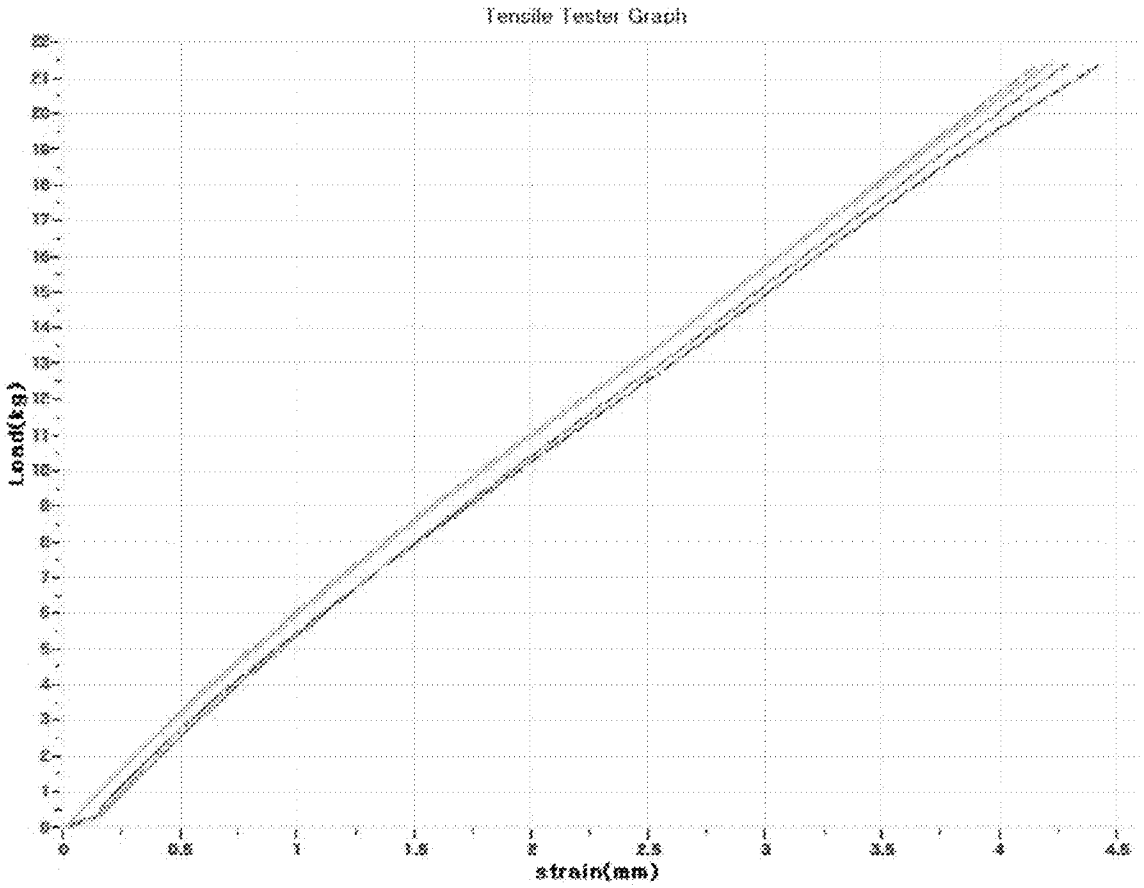
FIG. 7*a* is a view showing the result of an allowable weight test when a wall is a plywood board.
Figure 7B:
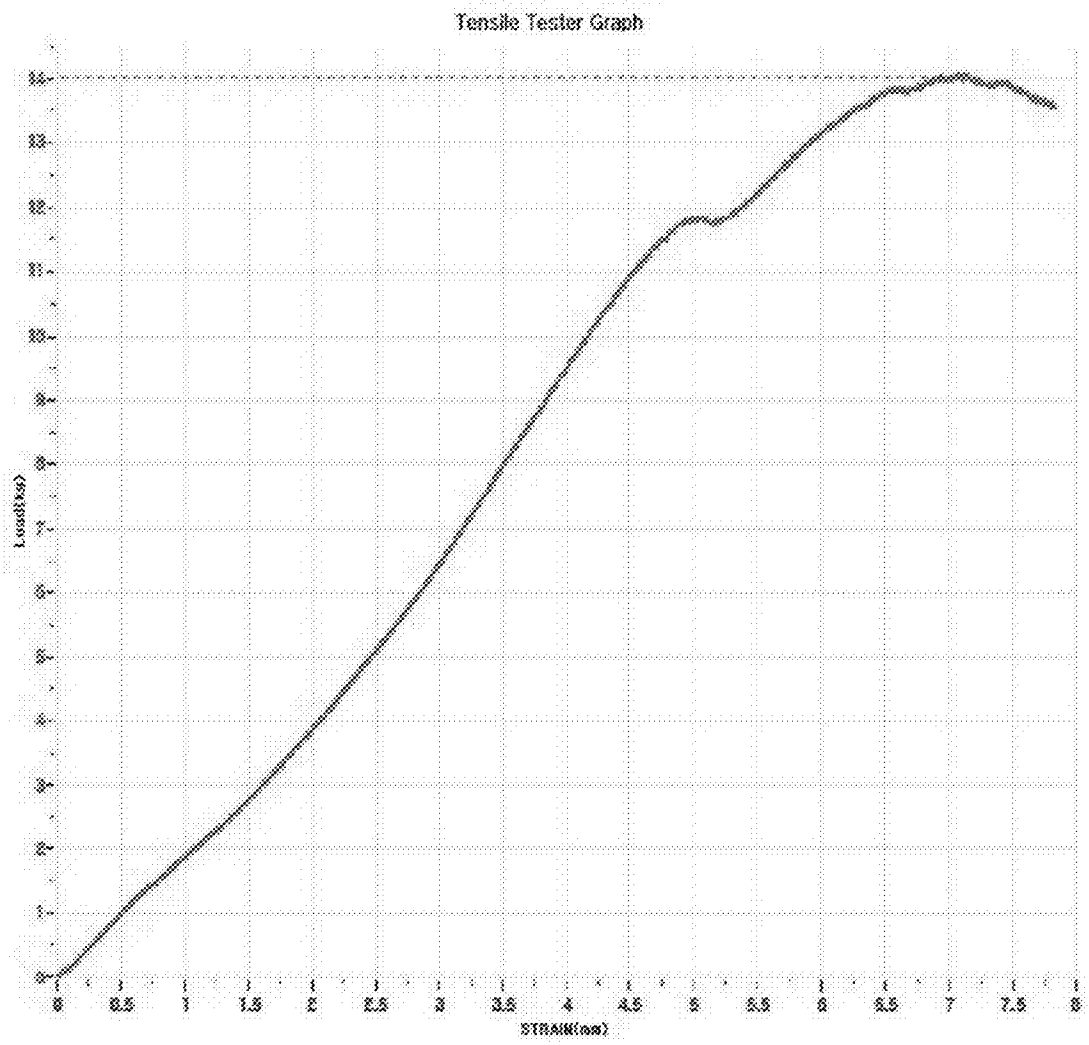
FIG. 7*b* is a view showing the result of an allowable weight test when a wall is a plaster board.

FIGS. 7*a* and 7*b* show values obtained by measuring load that one support can resist when wall plates are a plywood board and a plaster board, respectively.

In FIG. 7*a*, the maximum load of one support is 20 kgf. Thereafter, one of a straight support and a hooked support by one fixing support maintains a circle even under 75 kgf.

FIG. 7*b* shows a test result of a 3-layer plaster board, in which one support can resist up to 14 kgf, so when a wall is a plywood board, there is no problem, but when it is a plaster board, an object over 14 kg cannot be placed on one support, depending on whether there is shaking and on the allowable load. However, since there are generally two supports, it is possible to resist up to 28 kg.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

Therefore, the configurations described in the embodiments and drawings of the present disclosure are merely most preferable embodiments but do not represent all of the technical spirit of the present disclosure. Thus, it should be understood that the present disclosure should be construed as including all the changes, equivalents, and substitutions included in the spirit and scope of the present disclosure at the time of filing this application.

INDUSTRIAL APPLICABILITY

The present disclosure has an effect that it is possible to implement a non-support shelf, etc. that naturally attach various structures or decoration parts on a wall using a metal panel, so it has industrial applicability.

It is possible to change various structures on a wall by screw-fastening a protruding part of a support to a bottom support, separating the screw-fastened support, and inserting various supports, so the present disclosure has industrial applicability.

It is possible to replace various structures through a straight support, a hooked support, and a fixing part protruding from a metal plate, so the present disclosure has industrial applicability.

The invention claimed is:

1. A system wall for a building interior, comprising:

a wall part;

a bracket that is attached to the wall part;

a support that is attached to the bracket; and a hole-machined metal panel that corresponds to the support, wherein protrusions are formed at an edge of the bracket so that the hole-machined metal panel is firmly inserted, a curved part is configured at an edge of the hole-machined metal panel, and holes corresponding to the protrusions are configured at the curved part, and a decoration part that is inserted in the support protruding from the hole-machined metal panel is configured.

2. The system wall for a building interior of claim 1, wherein the support is composed of a bottom support and a straight support, and the bottom support is similar to a space of the bracket and is inserted by forcible fitting.

3. The system wall for a building interior of claim 2, wherein the straight support is screw-fastened to the bottom support.

4. The system wall for a building interior of claim 2, wherein the bottom support has an anti-rotation key groove to insert an anti-rotation key.

5. The system wall for a building interior of claim 1, wherein the hole-machined metal panel is a metal panel at which a hole is machined to insert a protrusion of the support.

6. The system wall for a building interior of claim 1, wherein the decoration part is any one of a shelf part, a box part, and a hooked support.

7. The system wall for a building interior of claim 1, wherein the decoration part is inserted and then the decoration part and the support are fixed by a fixing screw part.

8. The system wall for a building interior of claim 1, wherein the support is composed of a bottom support and a straight support, and the bottom support has bolt insertion parts.

9. The system wall for a building interior of claim 8, wherein the straight support is screw-fastened to the bottom support.

10. The system wall for a building interior of claim 8, wherein the bottom support has an anti-rotation key groove to insert an anti-rotation key.

11. The system wall for a building interior of claim 1, wherein the support is composed of a bottom support and a hooked support, and the hooked support is screw-fastened to the bottom support.

12. The system wall for a building interior of claim 11, wherein the bottom support has an anti-rotation key groove to insert an anti-rotation key.

13. The system wall for a building interior of claim 1, wherein the support is composed of a bottom support, a fixing part, and a fixing screw part.

14. The system wall for a building interior of claim 13, wherein the bottom support has an anti-rotation key groove to insert an anti-rotation key.

15. The system wall for a building interior of claim 1, wherein the support has a shelf mounting hole.

* * * * *